US009194661B1

(12) United States Patent
Perciballi et al.

(10) Patent No.: US 9,194,661 B1
(45) Date of Patent: Nov. 24, 2015

(54) BALLISTIC ARMOR ASSEMBLY FOR VEHICLE-MOUNTED EXPLOSIVE CARRIER

(75) Inventors: William Joseph Perciballi, Phoenix, AZ (US); Richard F. Langner, Scottsdale, AZ (US); Rockne Hewes Carter, Phoenix, AZ (US)

(73) Assignee: Armorworks Enterprises, LLC, Chandler, AZ (US)

( * ) Notice: Subject to any disclaimer, the term of this patent is extended or adjusted under 35 U.S.C. 154(b) by 575 days.

(21) Appl. No.: 12/806,374

(22) Filed: Aug. 11, 2010

Related U.S. Application Data

(60) Provisional application No. 61/273,899, filed on Aug. 11, 2009.

(51) Int. Cl.
*B64D 7/00* (2006.01)
*F41H 5/007* (2006.01)

(52) U.S. Cl.
CPC ..... *F41H 5/007* (2013.01)

(58) Field of Classification Search
USPC ..... 89/36.01, 36.02, 36.08, 36.09, 36.11, 89/36.12; 244/137.4
See application file for complete search history.

(56) References Cited

U.S. PATENT DOCUMENTS

| | | | | | |
|---|---|---|---|---|---|
| 3,988,961 | A * | 11/1976 | Banta et al. | ..... | 89/1.807 |
| 4,301,828 | A | 11/1981 | Martin, Jr. | | |
| 4,431,697 | A | 2/1984 | Rolinski et al. | | |
| 5,390,581 | A | 2/1995 | Hiltz et al. | | |
| 5,624,137 | A * | 4/1997 | Lesesne | ..... | 280/839 |
| 5,635,288 | A * | 6/1997 | Park | ..... | 428/105 |
| 5,905,225 | A * | 5/1999 | Joynt | ..... | 89/36.02 |
| 6,041,688 | A | 3/2000 | Woznica et al. | | |
| 6,497,966 | B2 * | 12/2002 | Cohen | ..... | 428/626 |

* cited by examiner

*Primary Examiner* — J. Woodrow Eldred
(74) *Attorney, Agent, or Firm* — Schwartz Law Firm, P.C.

(57) ABSTRACT

A ballistic armor assembly for a vehicle-mounted explosives carrier includes an assembly substrate and a ballistic composite. The assembly substrate is adapted for covering at least a portion of the explosives carrier, and has opposing inside and outside surfaces. The ballistic composite is secured to the outside surface of the assembly substrate. The ballistic composite includes a hard armor facing proximate a threat side of the ballistic armor assembly, and a flexible fabric backing proximate a protection side of the ballistic armor assembly.

17 Claims, 7 Drawing Sheets

BALLISTIC ARMOR ASSEMBLY FOR VEHICLE-MOUNTED EXPLOSIVE CARRIER

TECHNICAL FIELD AND BACKGROUND

The present disclosure relates broadly to a ballistic armor assembly for a vehicle-mounted explosives carrier, such as the M261 Missile Launcher used on military aircraft including the Apache AH Mk1/AH-64 attack helicopter.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a ballistic armor assembly for a vehicle-mounted explosives carrier. The armor assembly incorporates an assembly substrate and a ballistic composite. The assembly substrate is adapted for covering at least a portion of the explosives carrier, and has opposing inside and outside surfaces. The ballistic composite is secured to the outside surface of the assembly substrate. The ballistic composite includes a hard armor facing proximate a threat side of the ballistic armor assembly, and a flexible fabric backing proximate a protection side of the ballistic armor assembly.

The term "explosives carrier" is defined broadly and generally herein to mean any container, holder, support, frame, casing or the like which carries, contains, holds, or supports a flammable, combustible, or explosive material, such as missiles, rockets, ammunition, fuel, and the like.

According to another exemplary embodiment, the assembly substrate comprises a generally cylindrical metal armor casing.

According to another exemplary embodiment, the armor casing has a longitudinal hinge defining cooperating side sections adapted for pivoting between open and closed positions relative to the explosives carrier.

According to another exemplary embodiment, the armor casing includes a plurality of mechanical fasteners adapted for releasably securing the hinged side sections of the armor casing in the closed position.

According to another exemplary embodiment, the ballistic composite is arcuately formed at least 180 degrees around an outside of the armor casing.

According to another exemplary embodiment, the ballistic composite is arcuately formed greater than 180 degrees and less than 270 degrees around an outside of the armor casing.

According to another exemplary embodiment, the ballistic composite extends substantially an entire length of the armor casing.

According to another exemplary embodiment, the armor casing further comprises a plurality of elongated, longitudinally spaced, protective internal spacers adapted for residing adjacent the explosives carrier.

According to another exemplary embodiment, the assembly substrate comprises a plurality of protective internal spacers adapted for residing adjacent the explosives carrier.

According to another exemplary embodiment, the hard armor facing of the ballistic composite comprises a plurality of ceramic tiles.

According to another exemplary embodiment, the fabric backing of the ballistic composite comprises a plurality of overlying fabric layers incorporating high-performance ballistic fibers. Alternatively, the fabric backing may comprise an aramid matrix, prepreg fabric, or the like.

According to another exemplary embodiment, the ballistic fibers are selected from a group consisting of S-glass, aramid, high molecular weight polyethylene (HMWPE), polybenzobisoxazole (PBO), and polypyridobisimidazole (PIPD).

According to another exemplary embodiment, the ballistic composite comprises a fiberglass fabric cover surrounding the hard armor facing and fabric backing.

According to another exemplary embodiment, an electrical bonding strap is attached to the armor casing and adapted for discharging static electricity.

In another exemplary embodiment, the disclosure comprises a ballistic armor assembly in combination with a substantially cylindrical aircraft-mounted explosives carrier. The armor assembly includes a substantially cylindrical metal assembly substrate and a ballistic composite secured to an outside surface of the substrate. The assembly substrate is adapted for encasing at least a portion of the explosives carrier. The ballistic composite incorporates a hard armor facing proximate a threat side of the ballistic armor assembly, and a flexible fabric backing proximate a protection side of the ballistic armor assembly.

According to another exemplary embodiment, the explosives carrier comprises an aircraft-mounted weapons launcher. Alternatively, the explosives carrier may comprise (e.g.) a fuel tank.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
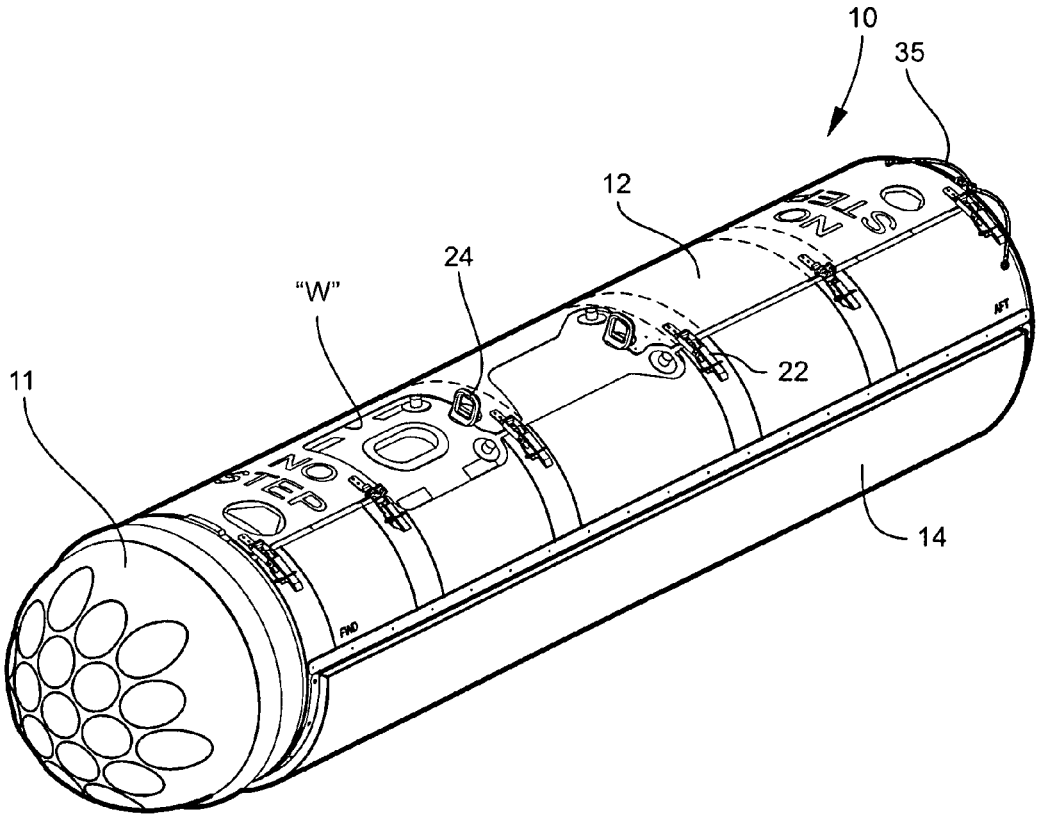
FIG. 1 is an environmental perspective view of a ballistic armor assembly according to one exemplary embodiment of the present disclosure, and showing the armor assembly applied to a vehicle-mounted weapons launcher.

Referring now specifically to the drawings, a ballistic armor assembly according to one exemplary embodiment of the present invention is illustrated in FIG. 1, and shown generally at reference numeral 10. The exemplary armor assembly 10 is designed to substantially encase and protect a generally cylindrical, lightweight missile launcher 11, such as the M261 Launcher used on military aircraft including the Apache AH Mk1/AH-64 attack helicopter. In other applications, the exemplary armor assembly 10 may shield explosives carriers (e.g., weapons holders, fuel tanks) on other vehicles, including land vehicles, other aircraft, ships, and the like.

Figure 2:
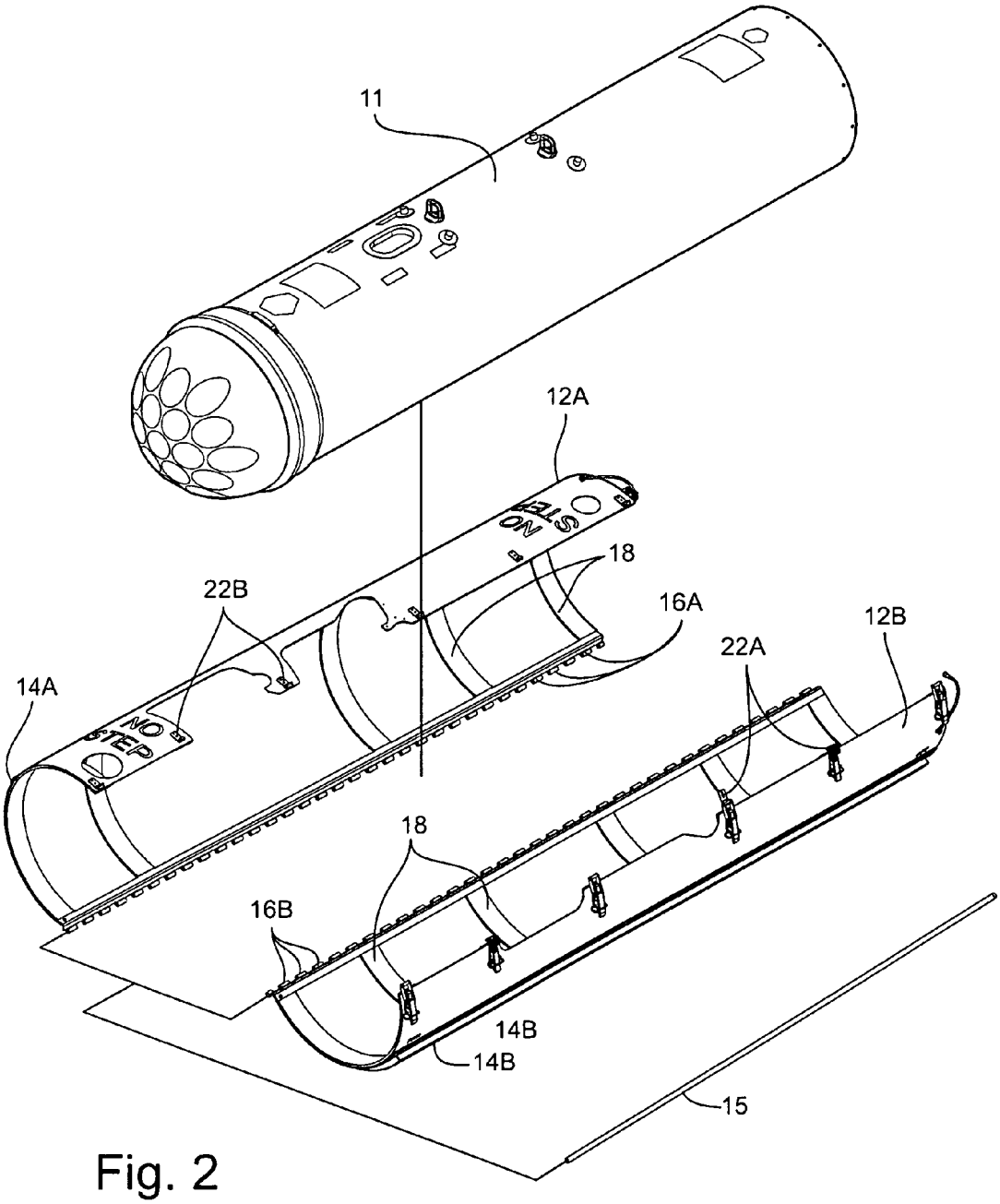
FIG. 2 is an exploded view of the exemplary armor assembly and launcher.

Referring to FIGS. 1 and 2, the armor assembly 10 includes a generally cylindrical open-end armor casing 12 (or "substrate"), and multi-component ballistic composite 14 secured to an outside of the casing 12. The armor casing 12 comprises a hinged two-piece aluminum construction including mating sections 12A, 12B designed to completely wrap around the missile launcher 11 in a closed position shown in FIG. 1. When closed, the armor casing 12 defines strategically placed windows "W" for readily viewing launch tube diagrams and other indicia applied to the launcher 11. In the present example, the ballistic composite 14 covers an underside of the armor casing 12 in a strategic area intended to maximize ballistic protection against small arms fire, shoulder-fired rockets, surface-to-air and air-to-air missiles, and other threats to the launcher 11.

Figure 3:
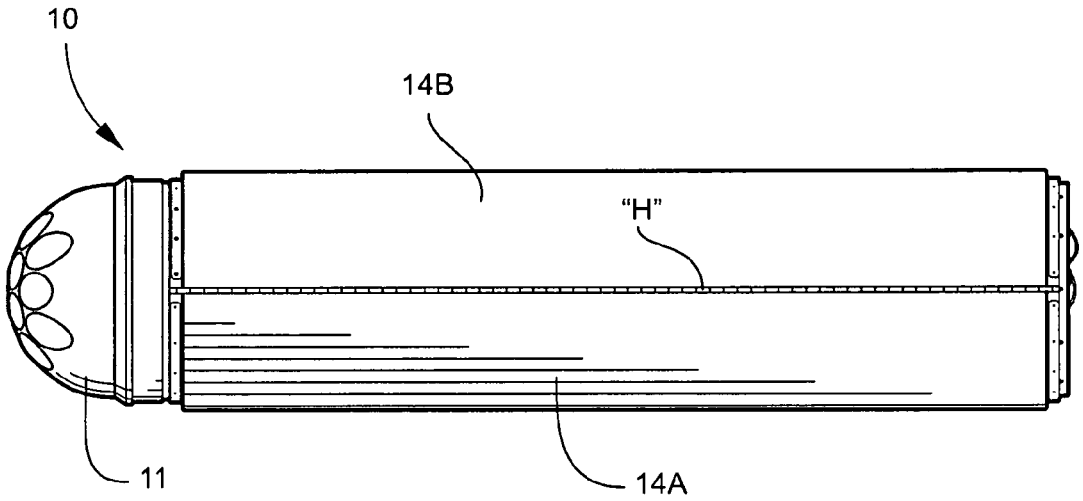
FIG. 3 is an underside view of the exemplary armor assembly and launcher.
Figure 4:
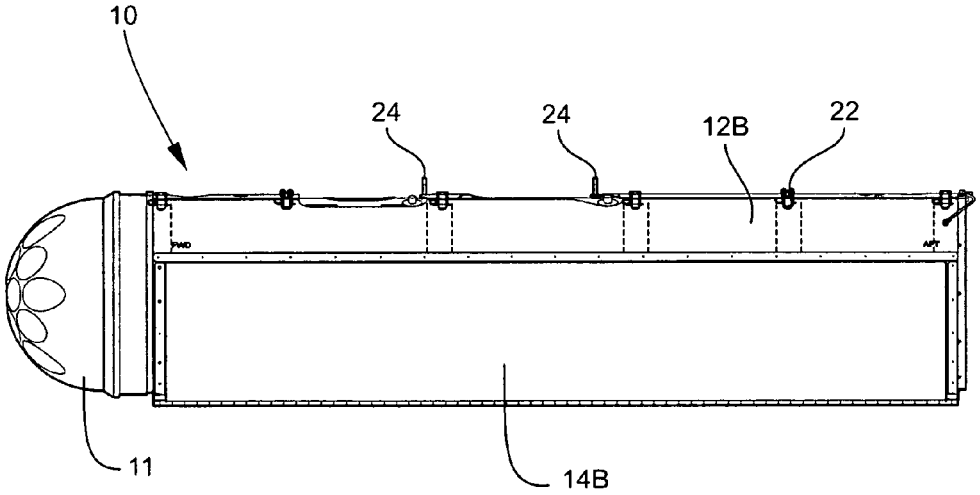
FIG. 4 is a side elevation of the exemplary armor assembly and launcher.
Figure 5:
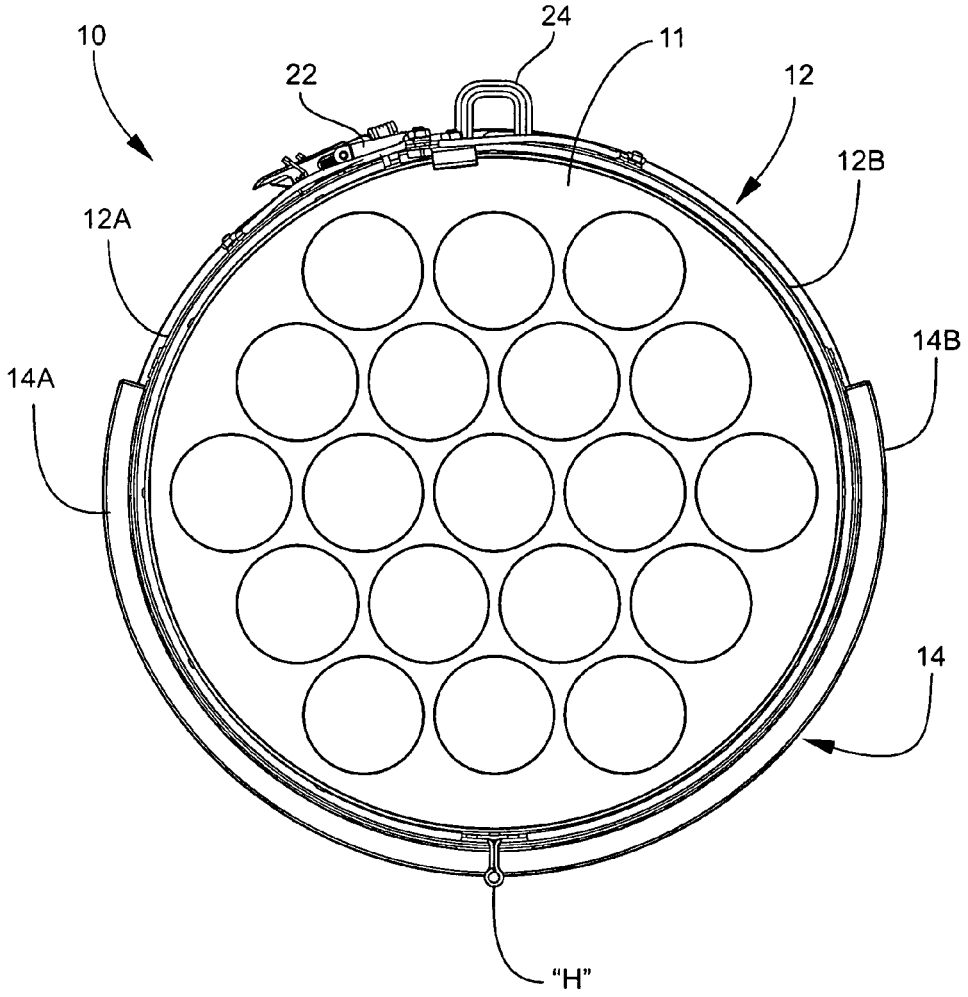
FIG. 5 is an end view of the exemplary armor assembly.

As best shown in FIG. 2, the casing sections 12A, 12B are substantially semi-cylindrical, and are hinged together via elongated metal pin 15 and linearly-aligned barrels 16A, 16B located along respective longitudinal edges of the sections 12A, 12B. The hinged sections 12A, 12B cooperate to open the armor casing 12 for application and removal of the armor assembly 10 to and from the missile launcher 11, and to close the armor casing 12 substantially 360-degrees around the launcher 11. Each casing section 12A, 12B may have a number of inside rubber spacer strips 18 designed to reduce vibration abrasion and other possible damage to the launcher 11, and to define a path for airflow between the armor assembly 10 and launcher 11. The armor casing 12 may be releasably locked in the closed position by spaced adjustable latching assemblies 22 comprising cooperating hooks 22A and latch catch plates 22B located adjacent longitudinal edges of respective casing sections 12A, 12B opposite the longitudinal hinge "H". The hinge "H" is centrally located in the armor casing 12, as shown in FIGS. 3 and 5, and divides the ballistic composite 14 into equal arcuate halves 14A, 14B extending from one end of the casing 12 to the other. The armor assembly 10 may extend along 80% or more of the entire length of the missile launcher 11. See FIG. 4. Additionally, the armor casing 12 may include spaced support hooks 24 designed to support the weight of the assembly 10 during installation.

Figure 6:
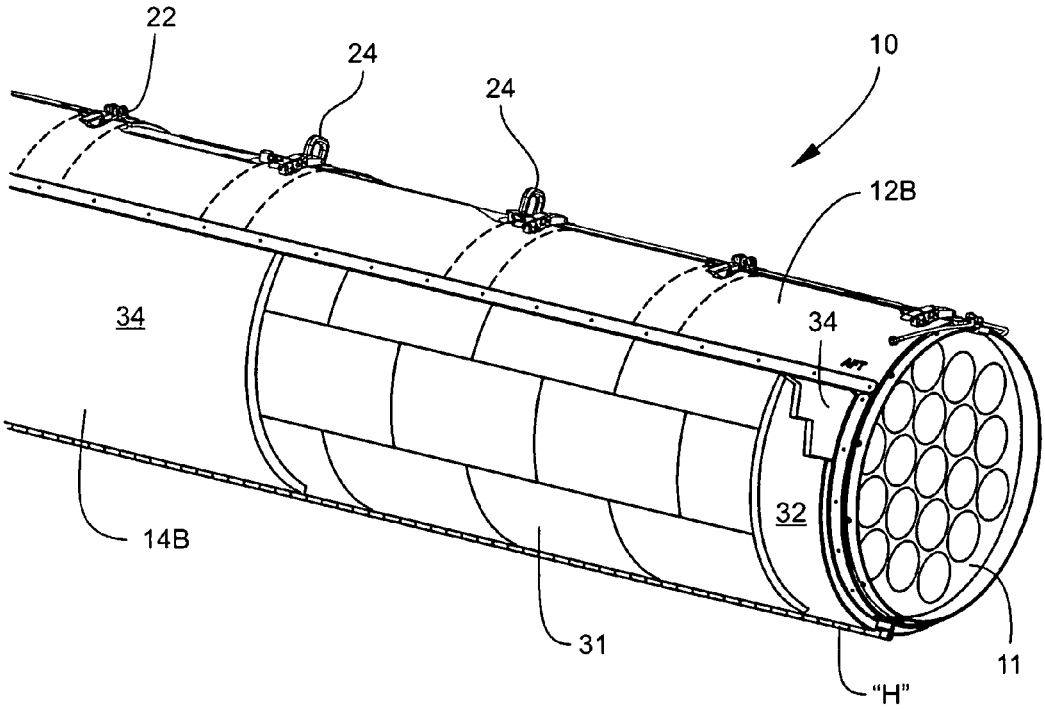
FIG. 6 is a fragmentary perspective view of the exemplary armor assembly and launcher with portions of the armor assembly broken away.
Figure 7:
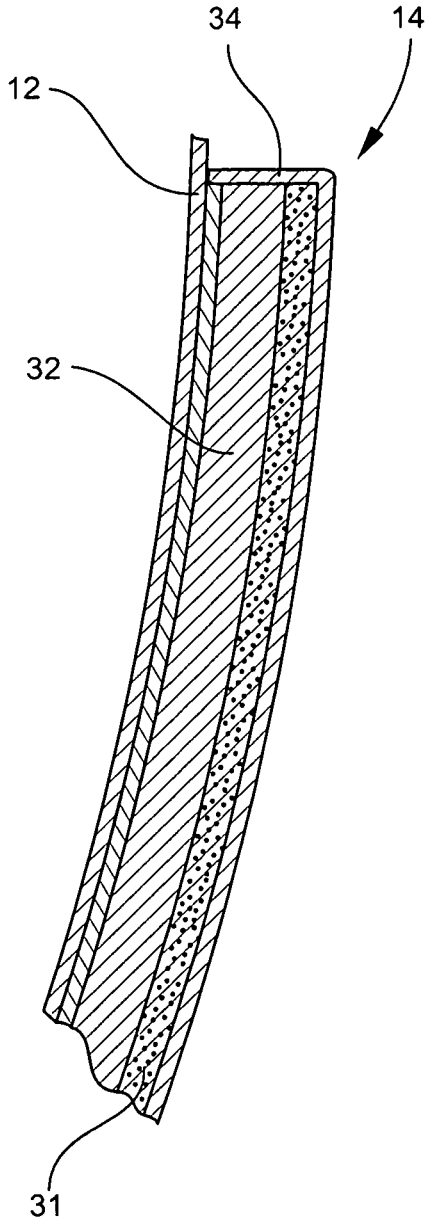
FIG. 7 is an enlarged fragmentary cross-sectional view of the exemplary armor assembly.

Referring to FIGS. 5, 6, and 7, the multi-component ballistic composite 14 is applied to the outside of the cylindrical armor casing 12 with each half 14A, 14B extending approximately 105-degrees arcuately outward from the central hinge "H". Collectively, the composite halves 14A, 14B define a 210-degree area of ballistic protection adjacent an underside of the missile launcher 11—although greater or lesser areas of coverage may be desired for alternative applications.

As best shown in FIGS. 6 and 7, the exemplary composite 14 comprises a hard armor facing 31 residing nearest a threat side of the armor assembly 10, and flexible fabric backing 32 nearest a protection side of the assembly 10. The hard armor facing 31 is between 0.080-inches to 0.40 inches thick, and may comprise a boron carbide ceramic, silicon carbide ceramic, or a ceramic matrix composite containing boron carbide ceramic and/or silicon carbide ceramic particles. The ceramic facing 31 may consist of a plurality of ceramic elements, such as tiles, molded with a curvature and arranged in an offset pattern sufficient to cover the cylindrical outer surface of the armor casing 12.

The exemplary fabric backing 32 incorporates multiple overlying layers of flexible ballistic fabric. The fabric layers may comprise continuous woven plies of ballistic yarns incorporating high-strength, high-modulus fibers. Examples of such "high performance" fibers include S-glass composed of silica ($SiO_2$), alumina ($Al_2O_3$), and magnesia (MgO); aramid fibers, such as commercially-known Twaron®, Technora®, and DuPont's Kevlar®29, Kevlar® 49, Kevlar® 129, and Kelvar® KM2; high molecular weight polyethylene (HMWPE), such as commercially-known Spectra® and Dyneema®; polybenzobisoxazole (PBO) fibers, such as commercially-known Zylon®; and polypyridobisimidazole (PIPD), such as commercially-known M5®. Such fibers may have a tensile strength greater than about 2000 MPa (or greater than about 7 grams per denier), and an elastic modulus greater than about 60 GPa. Alternative fiber structures in the exemplary fabric backing may comprise unidirectional configurations in one or more cross-plied fabric layers combined with (or in place of) the woven layers. In other embodiments, the armor assembly 10 may comprise an aramid matrix backing 32.

The ceramic facing 31 and backing 32 may be formed together using any suitable adhesive or bonding agent, and may be wrapped inside an outer nylon or fiberglass cover 34. The cover 34 may be comprised of a single material, or alternatively, may be a combination of fabric, rigid plastic, and foam designed to protects the ceramic facing and to contain ceramic particles on impact. The ballistic composite 14 may be mounted to the armor casing 12 using a transfer tape adhesive, bonding agent or the like. Additionally, the armor assembly 10 may be electrically grounded for static discharge protection using an electrical bonding strap 35.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A ballistic armor assembly for a vehicle-mounted explosives carrier, comprising:

an assembly substrate comprising a generally cylindrical metal armor casing adapted for covering at least a portion of the explosives carrier, and having opposing inside and outside surfaces, and said armor casing comprising a longitudinal hinge defining cooperating side sections adapted for pivoting between open and closed positions relative to the explosives carrier;

a ballistic composite secured to the outside surface of said assembly substrate, and comprising a hard armor facing proximate a threat side of said ballistic armor assembly and a flexible fabric backing proximate a protection side of said ballistic armor assembly.

2. A ballistic armor assembly according to claim 1, wherein said armor casing comprises a plurality of mechanical fasteners adapted for releasably securing the hinged side sections of said armor casing in the closed position.

3. A ballistic armor assembly according to claim 1, wherein said ballistic composite is arcuately formed at least 180 degrees around an outside of said armor casing.

4. A ballistic armor assembly according to claim 1, wherein said ballistic composite is arcuately formed greater than 180 degrees and less than 270 degrees around an outside of said armor casing.

5. A ballistic armor assembly according to claim 1, wherein said ballistic composite extends substantially an entire length of said armor casing.

6. A ballistic armor assembly according to claim 1, wherein said armor casing further comprises a plurality of elongated, longitudinally spaced, protective internal spacers adapted for residing adjacent the explosives carrier between the explosives carrier and the inside surface of said assembly substrate.

7. A ballistic armor assembly according to claim 1, wherein said assembly substrate comprises a plurality of protective internal spacers adapted for residing adjacent the explosives carrier between the explosives carrier and the inside surface of said assembly substrate.

8. A ballistic armor assembly according to claim 1, wherein the hard armor facing of said ballistic composite comprises a plurality of ceramic tiles.

9. A ballistic armor assembly according to claim 8, wherein the fabric backing of said ballistic composite comprises a plurality of overlying fabric layers incorporating high-performance ballistic fibers.

10. A ballistic armor assembly according to claim 9, wherein said ballistic fibers are selected from a group consisting of S-glass, aramid, high molecular weight polyethylene (HMWPE), polybenzobisoxazole (PBO), and polypyridobisimidazole (PIPD).

11. A ballistic armor assembly according to claim 1, wherein said ballistic composite comprises a fiberglass fabric cover surrounding the hard armor facing and fabric backing.

12. A ballistic armor assembly according to claim 1, and comprising an electrical bonding strap attached to the armor casing and adapted for discharging static electricity.

13. In combination with a substantially cylindrical aircraft-mounted explosives carrier comprising an aircraft-mounted weapons launcher, a ballistic armor assembly comprising:

a substantially cylindrical metal assembly substrate adapted for encasing at least a portion of the explosives carrier, and having opposing inside and outside surfaces, and said assembly substrate comprising a longitudinal hinge defining cooperating side sections adapted for pivoting between open and closed positions relative to the weapons launcher; and a ballistic composite secured to the outside surface of said assembly substrate, and comprising a hard armor facing proximate a threat side of said ballistic armor assembly and a flexible fabric backing proximate a protection side of said ballistic armor assembly.

14. A combination according to claim 13, wherein said ballistic composite is arcuately formed greater than 180 degrees and less than 270 degrees around an outside of said weapons launcher.

15. A combination according to claim 14, wherein the hard armor facing of said ballistic composite comprises a plurality of ceramic tiles.

16. A combination according to claim 15, wherein the fabric backing of said ballistic composite comprises a plurality of overlying fabric layers incorporating high-performance ballistic fibers.

17. A ballistic armor assembly for a vehicle-mounted explosives carrier, comprising:

an assembly substrate comprising a generally cylindrical metal armor casing adapted for covering at least a portion of the explosives carrier, and having opposing inside and outside surfaces;

an electrical bonding strap attached to the armor casing and adapted for discharging static electricity; and a ballistic composite secured to the outside surface of said assembly substrate, and comprising a hard armor facing proximate a threat side of said ballistic armor assembly and a flexible fabric backing proximate a protection side of said ballistic armor assembly.

* * * * *